United States Patent [19]

Emmerich

[11] 4,424,782

[45] Jan. 10, 1984

[54] SHUT-OFF DEVICE FOR A SELF-IGNITING INTERNAL COMBUSTION ENGINE

[75] Inventor: Hubert Emmerich, Brühl, Fed. Rep. of Germany

[73] Assignee: Klöckner-Humboldt-Deutz Aktiengesellschaft, Cologne, Fed. Rep. of Germany

[21] Appl. No.: 300,637

[22] Filed: Sep. 9, 1981

[30] Foreign Application Priority Data

Sep. 10, 1980 [DE] Fed. Rep. of Germany ..... 3033971

[51] Int. Cl.[3] ..... F02D 7/00

[52] U.S. Cl. ..... 123/367; 123/198 DB

[58] Field of Search ..... 123/367, 365, 372, 378, 123/357, 198 DB

[56] References Cited

U.S. PATENT DOCUMENTS

| | | | |
|---|---|---|---|
| 2,195,927 | 4/1940 | Hurst et al. | 123/357 |
| 3,025,843 | 3/1962 | Wagner et al. | 123/367 |
| 3,640,259 | 2/1972 | Garcea | 123/365 |
| 3,741,178 | 6/1973 | Cedar | 123/198 DB |
| 3,865,090 | 2/1975 | Masters et al. | 123/198 DB |
| 3,871,344 | 3/1975 | Pigeroulet et al. | 123/367 |
| 4,088,110 | 5/1978 | Sperline | 123/198 DB |
| 4,243,004 | 1/1981 | Ritter et al. | 123/367 |
| 4,252,089 | 2/1981 | Kramer | 123/365 |
| 4,318,379 | 3/1982 | Knorreck | 123/387 |

FOREIGN PATENT DOCUMENTS 2716469 10/1978 Fed. Rep. of Germany .

*Primary Examiner*—Charles J. Myhre
*Assistant Examiner*—Magdalen Moy
*Attorney, Agent, or Firm*—Becker & Becker, Inc.

[57] ABSTRACT

A shut-off device for a self-igniting internal combustion engine which is equipped with a fuel injection pump for injecting fuel into the combustion chambers. The fuel injection pump is equipped with a feed-quantity control member, which can be held in a rest position by a spring, as well as with a starting or ignition switch, which is arranged in the electrical energy circuit of the internal combustion engine. The feed-quantity control member, as a function of the position of the starting or ignition switch, remains in a first rest position, which corresponds to low idling, or in a second rest position, which corresponds to standstill of the internal combustion engine.

1 Claim, 4 Drawing Figures

SHUT-OFF DEVICE FOR A SELF-IGNITING INTERNAL COMBUSTION ENGINE

The present invention relates to a shut-off device for a self-igniting internal combustion engine which is equipped with a fuel injection pump for injecting fuel into the combustion chambers; the fuel injection pump is provided with a feed-quantity control member, which can be held in a rest position by a spring, as well as with a starting or ignition switch, which is arranged in the electrical energy circuit of the internal combustion engine.

Particularly with self-igniting or compression-ignition internal combustion engines installed in motor vehicles, efforts have recently been made to facilitate the operation of these internal combustion engines, and in particular, if possible, to equate their operation with the operation of externally ignited internal combustion engines.

Thus, different proposals have already become known to simplify turning-off self-igniting internal combustion engines, which operation was previously carried out by actuating a special cutoff piston. In particular, this simplification is aimed at eliminating having to shift the feed-quantity control member into the zero-feed-quantity position by means of the cutoff piston, and accomplishing the shift by actuating the starting or ignition switch when the power supply to the motor vehicle is turned off by the ignition key.

It is known, for example, with distributing fuel injection pumps, to provide an electromagnetic shut-off valve in the fuel injection pump; in the zero position of the ignition switch, this valve prevents the distribution of fuel to the individual injection lines.

It is also known to provide an electromagnetically operating three-way valve in the supply conduit of the feed-quantity control member, which is acted upon by a pneumatic governor of a fuel injection pump (German Offenlegungsschrift No. 27 16 469). Furthermore, it is necessary for this purpose to provide an underpressure source (vacuum pump) which is driven by the internal combustion engine. By turning the starting or ignition key in the ignition switch from the operating position to "off" or "zero", the electromagnetically operating three-way valve is actuated in such a way that the underpressure of the vacuum pump is conveyed to the pneumatic governor in such a way that thereby the feed-quantity control member is shifted into the "zero feed" position. As soon as the internal combustion engine has come to a standstill, not only the underpressure but also the electrical energy are lacking, so that the electromagnetically operating three-way valve returns to its starting position, as a result of which the governor can no longer hold the feed-quantity control member in the zero feed position, so that the latter is returned to the starting position by a spring.

The disadvantage of this arrangement is that first of all a vacuum pump must be provided; if this pump fails, it is impossible to shut off the internal combustion engine. Second of all, if the motor vehicle is shut off while in gear, the engine could start during a movement of the motor vehicle, since the feed-quantity control member is in the "start" position, in which case fuel would be injected, so that, depending upon the temperature of the combustion chambers, self-ignition could occur.

It is, therefore, an object of the present invention to provide a shut-off device with which in a simple manner the feed-quantity control member can be adjusted to zero fuel feed.

This object, and other objects and advantages of the present invention, will appear more clearly from the following specification in connection with the accompanying drawing, in which.

Figure 3A:
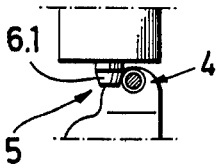
Figure 3B:
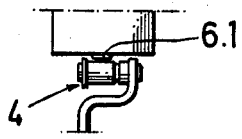

FIGS. 3*a* and 3*b* are enlarged detailed views showing the position of the abutment and counter-abutment in the switched-in and switched-out (energized and de-energized) condition of the solenoid respectively.

The shut-off device of the present invention is characterized primarily in that the feed-quantity control member, as a function of the position of the starting or ignition switch, remains in a first rest position, which corresponds to the low idling setting, or in a second rest position, which corresponds to standstill of the internal combustion engine.

The advantage of this arrangement is that the inventive device can be used in a similar manner both with distributing fuel injection pumps, as well as with progressive or sequential fuel injection pumps. A further advantage is that the feed-quantity control member remains in the zero feed position until the internal combustion engine is switched to start or operation by turning the ignition key in the ignition switch. Moreover, it is not necessary to equip the internal combustion engine with a vacuum pump. According to the present invention, as the feed-quantity control member, there can be used any element of the fuel injection system by means of which the fuel quantity fed to the combustion chambers of the internal combustion engine can be affected.

According to a preferred embodiment of the present invention, the feed-quantity control member may have an abutment which cooperates with a movable counter-abutment. This embodiment has the advantage of using already existing structural elements of fuel injection pumps and governors, with only the counter-abutment for the abutment of the feed-quantity control member having to be variable. This is possible, for example, by providing two positions into which the counter-abutment is moved and held by suitable devices, depending upon the position of the ignition switch.

However, it is equally conceivable to embody the counter-abutment such that the path of the feed-quantity control member can be restrained by the counter-abutment in the first rest position. In other words, for the first rest position, the counter-abutment is placed during operation into the path of the abutment for the feed-quantity-control member, and releases the path of the abutment into the second rest position for achieving standstill of the internal combustion engine.

This counter-abutment can be shifted especially easily into the path of the feed-quantity control member if the counter-abutment is the plunger of a solenoid or lifting magnet. Additionally, this embodiment has the advantage that no significant changes have to be made to the injection system in order to arrange the solenoid, so that the inventive device is especially also suitable for subsequent installation in already existing fuel injection systems.

According to a further embodiment of the present invention, the energized state of the solenoid places the counter-abutment in the first rest position for the abutment of the feed-quantity control member. This embodiment solves the problem of setting the fuel injection pump in a simple manner at zero feed as long as the power supply to the internal combustion engine is turned off. Consequently, no electrical energy is required for the solenoid during standstill of the internal combustion engine. A further advantage is that upon failure of the electrical energy supply system of the internal combustion engine, the engine is automatically turned off if this is desired by the operator, for instance by resetting or returning the feed-quantity control member.

According to an alternative embodiment of the present invention, the counter-abutment is the piston rod of a hydraulically or pneumatically actuatable cylinder-piston unit, with the pressure medium supply thereto being controlled by a solenoid valve. This alternative embodiment utilizes operating media of the internal combustion engine, i.e. lubricating oil or pressurized air, if available, for holding the counter-abutment in the first rest position (low idling). This has the advantage that likewise the counter-abutment releases the path of the feed-quantity control member in the second rest position when the operating media fail. The solenoid valve is embodied as a two-way valve which, as a function of the position of the starting or ignition switch, releases the pressure medium through-flow to the cylinder-piston unit, as a result of which the piston is shifted against the force of a spring in such a manner that its piston rod acts as a counter-abutment, or establishing a pressure-less connection of the cylinder/chamber of the cylinder-piston unit with the pressure medium return, whereby the piston rod releases the abutment.

Figure 1:
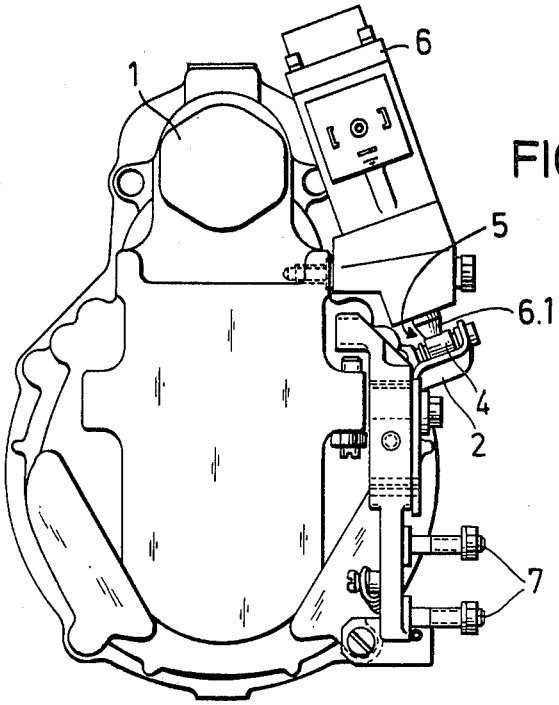
FIG. 1 is a front view of one embodiment of an inventive fuel injection pump governor having a lifting magnet or solenoid.
Figure 2:
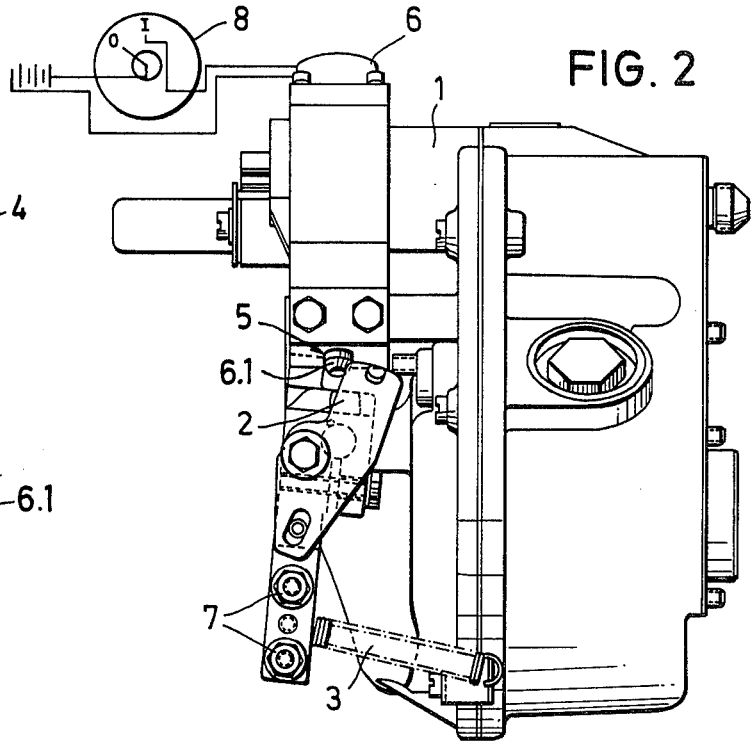
FIG. 2 is a side view of the governor of FIG. 1.

Referring now to the drawing in detail, the fuel injection pump governor or regulator 1 illustrated in FIG. 1 has a speed-control lever 2 as a feed-quantity control member. Such governors are generally known, so that their construction and functioning need not be set forth in greater detail (see, for instance, Mettig, The Construction of High-Speed Internal-Combustion Engines, de Gruyter 1973). As shown in FIG. 2, a pulling or tension spring 3 engages the speed-control lever 2. Furthermore, the speed-control lever 2 has a bolt or pin which is rigidly secured thereto and serves as an abutment 4. A suitable control member (not illustrated) on the speed-control lever 2 engages the two fastening elements 7 and regulates the speed-control lever 2 either at random or according to specific criteria. Conventionally, this is a linkage or a Bowden control cable with which the operator adjusts the speed of the internal combustion engine. With an internal combustion engine installed in a motor vehicle, this means that a gas pedal or lever operated by the driver engages the fastening elements 7.

The speed-control lever 2 has two rest positions. The first rest position forms a counter-abutment 5, which is formed by a solenoid plunger 6.1 of an electrical lifting magnet or solenoid 6 which is fastened to the governor 1. When the solenoid 6 is activated, the plunger 6.1 is extended. The second rest position lies below the solenoid plunger 6.1, which is retracted for this purpose into the solenoid 6 when the solenoid is de-energized.

In FIGS. 1 and 2, the governor 1 is illustrated in an operating position, i.e., the fuel injection pump connected therewith delivers fuel to the internal combustion engine. For this reason, the counter-abutment 5 is lowered, so that the abutment 4 of the speed-control lever 2 cannot assume the second rest position, which in FIG. 2 would be to the left of the present position of the speed-control lever 2. The illustrated position of FIG. 2 is only obtained when a force engages the speed-control lever at the two fastening elements 7 which overcomes the force of the return spring 3 and of the control elements.

FIG. 3*a* shows a detailed view of the abutment 4 and the counter-abutment 5, with the solenoid 6 being energized and essentially only the force of the return spring 3 acting upon the speed-control lever 2. The abutment 4 engages the counter-abutment 5 in this situation. This means that the internal combustion engine is operated in its low idling setting, and the speed-control lever 2 is in the first rest position.

To turn off the internal combustion engine, the starting or ignition switch 8 is shifted from the operating position I to zero. Accordingly, energy supply to the solenoid is eliminated, so that the counter-abutment 5 is retracted into the solenoid 6. Consequently, the return spring 3 can shift the speed-control lever 2 further, and in particular, until the second rest position of the speed-control lever 2, which corresponds to standstill of the internal combustion engine, is reached. This position is illustrated in FIG. 3*b*. It should be noted that in this situation the counter-abutment 5 is arranged above the abutment 4 in such a manner that when the internal combustion engine is turned on, without moving the speed-control lever 2, the counter-abutment 5 pushes against the abutment 4 from above, so that with a subsequent actuation of the speed-control lever 2, which is necessary for starting, the counter-abutment 5 does not restrain the lever 2 in its second rest position.

In summary, the speed control lever 2 which is connected to the fuel pump 1 moves between a first position (FIG. 3*b*) in which the engine is stopped and no gas is fed thereto; a second position (FIG. 3*a*) in which the engine idles, and a third position in which the tension spring 3 is extended substantially and the engine is running at a maximum speed. The tension spring 3 has a bias which urges the speed control lever to the first position of FIG. 3*b* when the solenoid 6.1 is retracted. However, if the solenoid plunger 6.1 is projected, then the tension spring 3 can only urge the speed control lever as far as the idle condition shown in FIG. 3*a*. The operator of the engine selects the particular running speed by, in effect, pulling on a cable attached to bolts 7 on the speed control lever so as to move the lever against the bias of tension spring 3. As is seen in the figures, the speed control lever 2 is directly abutted by the plunger 6.1 when the engine is in its idle condition without the need for intermediary linkages.

The ignition control switch 8 is movable between a first position wherein the engine is running and a second position wherein the engine is not running. When the ignition control switch is in second position, the solenoid 6.1 is withdrawn, as is shown in FIG. 3*b*.

The present invention is, of course, in no way restricted to the specific disclosure of the specification and drawing, but also encompasses any modifications within the scope of the appended claims.

What I claim is:

1. In combination with a diesel internal combustion engine having at least one combustion chamber into which fuel is directly injected by a fuel-injection pump, wherein the engine is operated by an ignition switch to run when the ignition switch is in a first position indicating "on" and to stop when the ignition switch is in a second position indicating "off"; the improvement characterized by:

a speed control lever connected to the fuel-injection pump and pivoted with respect thereto for movement in an arcuate path between a first position in which no fuel is injected and the engine is stopped; a second position in which the engine idles, and a third position in which the engine operates at maximum speed;

a spring attached to the speed control lever, the spring having a bias for urging the lever toward the first position wherein no fuel is injected and the engine stops;

means attached to the speed control lever for selectively moving the lever toward the third position against the bias of the spring to increase the speed of the engine when desired;

a solenoid including a plunger; the plunger projecting into the arcuate path of movement of the speed control lever when the solenoid is energized and out of the arcuate path of movement of the speed control lever when the solenoid is deenergized; the plunger being positioned adjacent to the second position of the speed control lever for holding the speed control lever in the second position when projected, by directly engaging the speed control lever to hold the engine at idle when the means for moving the speed control lever is released, and an electrical power circuit connected to the solenoid for energizing the solenoid, the electrical power circuit including the ignition switch connected therein, the ignition switch opening the circuit to interrupt power to the solenoid when in the second position and closing the circuit to project the plunger when in the first position; whereby the normal condition of the engine is the idle condition when the ignition switch is in the first position and the normal condition of the engine is "stopped" when the ignition switch is in the second position, and whereby the means for moving the speed control lever advances the lever from the first position of the lever when the ignition switch is "off" and advances the lever from the second position thereof when the ignition switch is "on".

* * * * *